United States Patent [19]

Wolff

[11] Patent Number: 4,934,695

[45] Date of Patent: Jun. 19, 1990

[54] EXERCISING APPARATUS

[76] Inventor: Friedrich Wolff, Störklingasse 44, CH-4125 Riehen/Basel, Switzerland

[21] Appl. No.: 336,662

[22] Filed: Apr. 11, 1989

[30] Foreign Application Priority Data

Apr. 16, 1988 [DE] Fed. Rep. of Germany ..... 3812699

[51] Int. Cl.[5] ..... A63B 21/00; A63B 21/008; A63B 21/04

[52] U.S. Cl. ..... 272/134; 272/129; 272/130; 272/136

[58] Field of Search ..... 272/73, 130, 132, 136, 272/134, 144, 67, 129, 142

[56] References Cited

U.S. PATENT DOCUMENTS

| | | | |
|---|---|---|---|
| 3,587,319 | 6/1971 | Andrews | 272/130 X |
| 3,638,941 | 2/1972 | Kulkens | 272/130 |
| 3,712,613 | 1/1973 | Feather et al. | 272/134 X |
| 3,759,512 | 9/1973 | Yount et al. | 272/73 X |
| 3,768,803 | 10/1923 | Passera . | |
| 4,235,437 | 11/1980 | Ruis et al. | 272/130 X |
| 4,452,447 | 6/1984 | Leplet et al. | 272/130 X |
| 4,569,519 | 2/1986 | Mattox et al. | 272/134 X |
| 4,629,185 | 12/1986 | Amann | 272/130 |
| 4,641,837 | 2/1987 | Ruth | 272/144 X |
| 4,662,631 | 5/1987 | Seal | 272/144 X |
| 4,666,151 | 5/1987 | Chillier | 272/134 |
| 4,735,410 | 4/1988 | Nobuta | 272/130 X |

FOREIGN PATENT DOCUMENTS

| | | | |
|---|---|---|---|
| 2128659 | 6/1972 | Fed. Rep. of Germany . | |
| 7123728 | 10/1973 | Fed. Rep. of Germany . | |
| 2827288 | 1/1979 | Fed. Rep. of Germany . | |
| 2564735 | 11/1985 | France | 272/130 |

*Primary Examiner*—Robert W. Bahr
*Attorney, Agent, or Firm*—Peter K. Kontler

[57] ABSTRACT

Exercising or body building apparatus wherein the frame supports two levers which are mounted on spherical joints and carry handles which are movable longitudinally of the respective levers. Adjustable loads are provided to yieldably resist movements of the handles longitudinally and/or transversely of the frame and/or away from the respective joints. The frame carries a bed which can be converted into a seat for the exerciser, and the frame confines a pair of pedals which can be reached and driven by the legs when the bed is converted into a seat.

32 Claims, 2 Drawing Sheets

EXERCISING APPARATUS

BACKGROUND OF THE INVENTION

The invention relates to exercising or physical training apparatus in general, and more particularly to improvements in exercising apparatus of the type wherein a support is provided with a seat or an analogous body supporting facility which is flanked by two movably mounted levers.

It is well known to equip a so-called rowing machine with two levers which are operated not unlike oars and are pivotable about horizontal axes against a resistance or load. Reference may be had, for example, to U.S. Pat. No. 4,735,410 to Nobuta. The resistance (actually the moment of resistance) is offered by a load in the form of hydraulic cylinders which are connected with a source of hydraulic fluid by flow restricting or damping means. The magnitude of resistance can be changed by varying the points of attachment of cylinders to the levers. The purpose of such exercising apparatus is to strengthen the circulatory system of the exerciser as a result of continuous stressing. A drawback of a rowing machine or an analogous exercising apparatus is that only selected muscles and/or body parts are active when the apparatus is in use.

It is also known to design exercising apparatus for the express purpose of strengthening only selected muscles of the user, particularly to subject such selected muscles to very pronounced short-lasting stresses to thus promote their growth.

In addition to the aforediscussed patent to Nobuta, applicant is aware of the disclosures in U.S. Pat. No. 3,768,808 to Passera, German Utility Model No. 78 27 288 of Ariabel, and published German patent application No. 2 128 659 of Passera. U.S. Pat. No. 3,768,808 to Passera discloses a portable kit which can be assembled in a number of different ways to serve as a means for exercising different muscles and/or different body parts. The published German application of Passera also discloses a portable exercising apparatus wherein two levers are mounted on spherical joints and are confined to movements in selected directions by forked guides which are detachably secured to the housing. The Utility Model of Ariabel discloses a single upright tubular member of variable length which is mounted on a spherical joint for limited pivotal movement in any one of a number of different directions.

OBJECTS OF THE INVENTION

An object of the invention is to provide an exercising apparatus (e.g., a so-called rowing apparatus) which is more versatile than heretofore known apparatus in that it enables the user to exercise any one of a number of different body parts and/or muscles.

Another object of the invention is to provide the exercising apparatus with novel and improved means for offering resistance to movements of levers, arms, oars or analogous parts which are to be moved by the user of the apparatus.

A further object of the invention is to provide an apparatus which can be used with advantage to exercise arm muscles, leg muscles or muscles in other parts of the body of the exerciser.

An additional object of the invention is to provide an apparatus which can be used as an exercising or body building machine and which can be used by adolescents and adults as well as by the members of both sexes.

Still another object of the invention is to provide the apparatus with novel and improved handles or bindings which can be used to transmit motion to the levers, either by the hands or by the legs of an exercising.

A further object of the invention is to provide the apparatus with novel and improved means for varying the resistance to movements of the levers in desired directions.

Another object of the invention is to provide a simple, compact and inexpensive exercising apparatus which can be used in gyms as well as in private homes or convalescent homes, by amateurs or professionals and by persons who merely desire to stay in shape or by persons who desire to treat or build selected body parts.

A further object of the invention is to provide a novel and improved support for the body of the exerciser.

An additional object of the invention is to provide an apparatus which can be set up to permit the exercising of arm muscles simultaneously with the exercising of leg muscles and wherein the means for exercising arm muscles can be used with equal or similar advantage for exercising leg muscles.

SUMMARY OF THE INVENTION

The invention is embodied in an exercising apparatus which comprises a support having a body supporting facility, two levers, means for movably mounting the levers on the support with freedom of movement in at least two different directions, and resistance or load means for yieldably resisting movements of the levers in the at least two directions. Each lever is preferably pivotable in two mutually inclined directions, and the mounting means preferably includes a spherical or universal joint for each lever. The apparatus further comprises a handle for each lever. The levers are preferably designed in such a way that each handle is movable toward and away from the respective mounting means longitudinally of the corresponding lever. To this end, each lever can comprise a plurality of sections which are slidably telescoped into each other.

Each handle can comprise two substantially horizontal portions which are spaced apart from each other in the longitudinal direction of the respective lever and/or two portions which are substantially parallel with the respective lever and are spaced apart from each other transversely of the respective lever. Each handle can be padded.

The resistance means can comprise at least one prestressed spring for each lever. Furthermore, the resistance means can comprise at least one hydraulic cylinder and piston unit and means for throttling the flow of fluid into and/or from the cylinder and piston unit. The throttling means can include at least one adjustable throttle valve. The valve constitutes a means for adjusting the resistance means, and the apparatus further comprises means for adjusting the valve.

The levers can be mounted for forward and rearward movement in at least one of the directions. The resistance means of such apparatus can include first adjustable loads which oppose forward movements of the levers in the at least one direction, and second adjustable loads which oppose rearward movements of the levers in the at least one direction. Discrete adjusting means can be provided for the first and second loads. Such adjusting means can be operated by remote controls. At least one of the adjusting means can include means for adjusting the respective load by remote control and/or in accordance with a predetermined program and/or in dependency upon the magnitude of stress on the user of the apparatus. If at least a portion of the resistance means is adjustable and includes a supply of hydraulic fluid, the temperature of such fluid will normally vary in dependency on the stress upon the user of the apparatus. The adjusting means for the aforementioned portion of the resistance means can include means for monitoring the temperature of the fluid and means for displaying the monitored temperature of the fluid and/or means for regulating the resistance of the aforementioned portion of the resistance means as a function of changes of the temperature of fluid.

In accordance with a presently preferred embodiment, the resistance means comprises a first and a second hydraulic cylinder and piston unit for each lever. Each first unit has a first portion (e.g., a piston rod) coupled to the respective lever and a second portion (e.g., a double-acting cylinder) pivotally secured to the support for movement about a substantially vertical axis. The first portions are movable relative to the respective second portions. Each second unit includes a first portion (e.g., a double-acting cylinder) pivotally secured to the support for movement about a substantially vertical axis and a second portion (e.g., a piston rod) movable relative to the first portion of the respective second unit and coupled to the second portion of the respective first unit. Such apparatus further comprises a source of hydraulic fluid and conduits connecting the source with the cylinder and piston units. Each cylinder has a first and a second chamber and the conduits include first conduits which connect the first chambers of cylinders in each of the first and second units, second conduits which connect the second chambers of the cylinders in each of the first and second units, and a third conduit which is connected to the source. Such apparatus further comprises a throttle valve connected between each first and second conduit on the one hand and the third conduit on the other hand, and check valves connected in parallel with the throttle valves to admit fluid from the third conduit into the first and second conduits.

A common function table can be provided for the mounting means and the first and second cylinder and piston units. Such table can constitute the source of hydraulic fluid for the cylinder and piston units.

The body supporting facility can be set up to include or constitute a bed. A section of such bed is preferably convertible into the back of a seat. The width of the convertible section can be less than the width of the bed, and the bed can further include a displaceable (e.g., pivotable or removable) second section which is preferably located in front of the convertible section. An exercising unit can be installed in or on the support beneath the second section so that it becomes accessible to the legs of the user upon displacement of the second section. The exercising unit can include pedals which are rotatable about a substantially horizontal axis. The support can include a closed frame beneath the bed. The adjusting means for the resistance means can be mounted on one or both sidewalls of the closed frame.

The apparatus can further comprise means for changing the level and/or the inclination of the body supporting facility. The apparatus can also comprise means for changing the level of the handles with reference to the level of the body supporting facility and/or with reference to the pedals or vice versa, and/or means for changing the level of the pedals with reference to the level of the body supporting facility or vice versa.

The novel features which are considered as characteristic of the invention are set forth in particular in the appended claims. The improved exercising apparatus itself, however, both as to its construction and its mode of operation, together with additional features and advantages thereof, will be best understood upon perusal of the following detailed description of certain specific embodiments with reference to the accompanying drawing.

DESCRIPTION OF PREFERRED EMBODIMENTS

Figure 1:
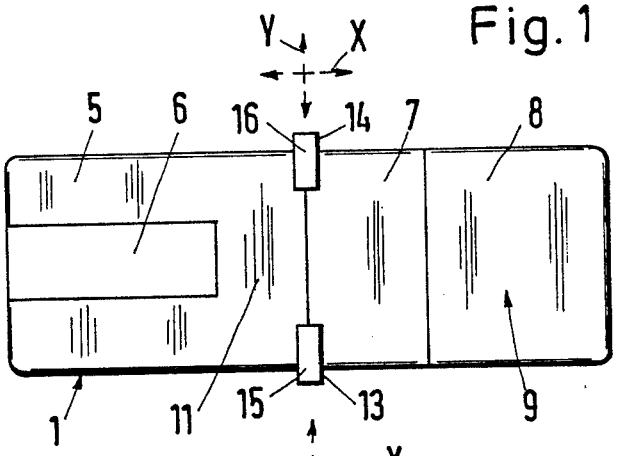
FIG. 1 is a schematic plan view of an exercising apparatus which embodies one form of the invention.

The exercising apparatus 1 which is shown in FIG. 1 comprises a closed frame or support 2 with two upright members 3 at the corners of the rear part and two upright members 4 at the corners of the front part of the frame. The frame 2 carries a body supporting facility including four cushioned sections 5, 6, 7, 8 which can be moved into a common substantially horizontal plane to form a bed 9 (see FIGS. 1 and 2). The section 6 is partially surrounded by the U-shaped section 5 and is provided with a brace 10 so that it can be held in the raised position 6*a* of FIG. 3 in which it constitutes the back of a seat. The base 11 of such seat is constituted by the section 5. The sections 7, 8 are articulately connected to each other by a horizontal hinge 7*a*, and the section 8 is articulately connected to the frame 2 by a horizontal hinge 8*a* to enable the sections 7, 8 to move to vertical positions as shown in FIG. 3. This exposes approximately one-half of the interior of the frame 2 and affords access to an optional exercising unit 56 having pedals 57 which can be rotated about a horizontal axis by the person occupying the seat 11 in the raised position 6*a* of the section 6 and in the vertical positions of the sections 7, 8.

The upright members 3 and 4 have vertically adjustable floor-contacting legs 12 which can be adjusted by hand or by motor means. If the rear legs 12 are extended (as shown in FIG. 3), the bed 9 which is formed by the cushions 5 to 8 is inclined forwardly and downwardly. If the front legs (not specifically shown) are extended jointly with the rear legs 12, the level of the bed 9 is raised accordingly; this might be necessary if the exercising apparatus 1 is used as a massaging table or for certain other purposes.

The seating facility 5–9 is flanked by two elongated levers 13 and 14 the upper end portions of which carry discrete handles 15 and 16, respectively. The means for mounting the lower end portions of the levers 13, 14 in the frame 1 comprises spherical joints 17 (e.g., ball and socket joints) each of which is designed to permit movements of the respective arm in several directions, particularly in planes which are parallel with the longitudinal direction of the frame 2 (note the arrows X in FIGS. 1 and 2), and in planes at right angles to such directions (note the arrow Y in FIG. 1). In addition, each lever is assembled of several sections (note the sections 13*a*–13*d* in FIG. 3) which are telescoped into each other so that the handles 15, 16 are movable in directions which are indicated by arrow Z (FIG. 2), i.e., longitudinally of the respective levers 13, 14 toward and away from the corresponding joints 17 and the sections 5–8. The handles 15, 16 can be releasably locked at selected distances from the respective joints 17.

The exercising apparatus 1 further comprises resistance means or loads which oppose the movements of handles 15, 16 in the directions of arrows X, Y and Z.

Figure 4:
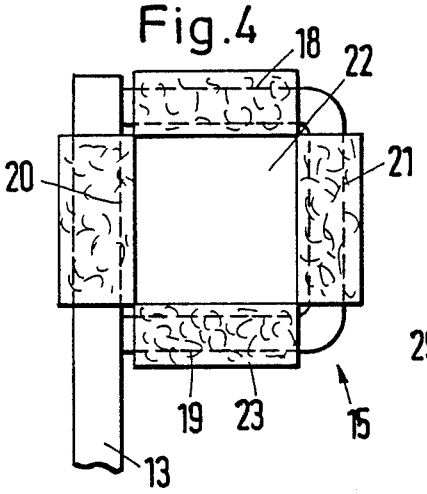
FIG. 4 is an enlarged view of one of the handles.
Figure 6:
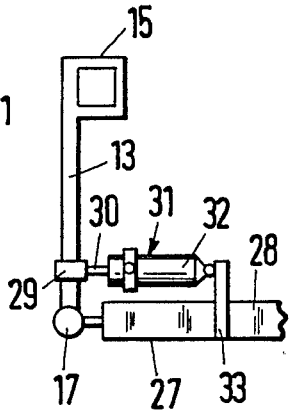
FIG. 6 is a fragmentary end elevational view of one lever and of the associated resistance means, substantially as seen in the direction of arrows from the line VI—VI of FIG. 7.
Figure 7:
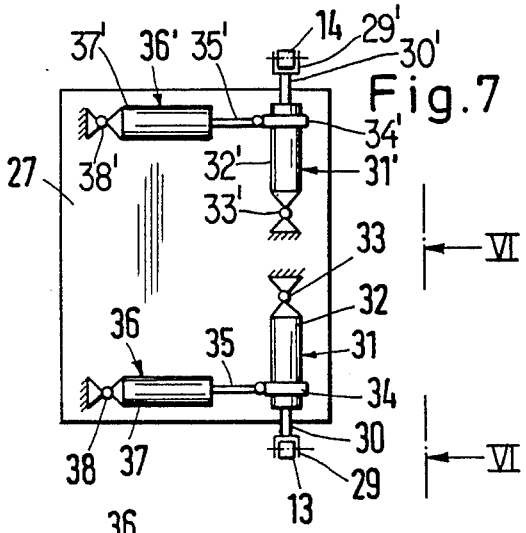
FIG. 7 is a plan view of the levers and of the associated resistance means.

FIG. 4 is an enlarged view of the handle 15 at the upper end of the lever 13. This handle comprises two horizontal sections or portions 18, 19 which extend transversely of the longitudinal direction of the lever 13 and at right handles to the other two sections or portions 20, 21 which extend in the longitudinal direction of the lever and are spaced apart from each other transversely of such direction. All four portions 18–21 of the handle 15 are padded, as at 23. The space 22 within the portions 18–21 can receive a portion of a hand or a portion of a foot of the person occupying the facility including the sections 5 to 8. The handle 16 is preferably a mirror image of the handle 15.

Figure 5:
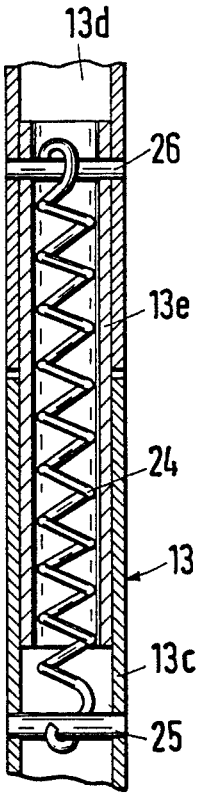
FIG. 5 is a fragmentary central longitudinal sectional view of a lever.

The means for offering resistance to lengthening of the levers 13, 14 includes resilient elements in the form of coil springs 24. As can be seen in FIG. 5, the coil spring 24 for the handle 13 is mounted in the sections 13*c*, 13*d* each of which is a length of tubular metallic stock, e.g., a piece of stainless steel pipe. The section 13*d* contains a smaller-diameter section 13*e* which is slidably telescoped into the upper portion of the section 13*c*. One end portion of the coil spring 24 (which is installed in prestressed condition) is attached to a transversely extending pin-shaped retainer 26 which is anchored in the sections 13*d*, 13*e*, and the other end portion of the coil spring 24 is affixed to a pin-shaped retainer 25 which is installed in the section 13*c*.

The section 13*c* is rigidly connected with the smaller-diameter tubular section 13*b* (FIG. 3) which is slidably telescoped into the tubular section 13*a*. The latter is connected to the respective universal joint 17. A second prestressed coil spring (not shown) can be installed in the sections 13*a*, 13*b* to draw the section 13*b* into the section 13*a*. The initial stress of the coil spring in the sections 13*a*, 13*b* can be much more pronounced than that of the coil spring 24 in the sections 13*c*, 13*e* or vice versa. It is equally possible to rigidly secure the section 13*b* to the section 13*a* so that only the sections 13*d*, 13*e* are movable relative to the section 13*c*.

The lower portion of the frame 2 contains or supports a function table 27 with an upwardly extending rim 28 so that the table 27 constitutes an oil pan. The aforementioned spherical or universal joints 17 for the levers 13 and 14 are mounted at the respective sides of the table 27. The latter further supports two mirror symmetrical sockets 29 and 29′ which engage the respective levers 13, 14 at the level above the corresponding joints 17. The levers 13, 14 are pivotable in the respective sockets 29, 29′ about substantially horizontal axes which are parallel with the longitudinal sides of the frame 2. This enables the handles 15 and 16 to move toward or away from each other (arrow Y in FIG. 1) against the opposition of resistance means including two double-acting hydraulic cylinder and piston units 31 and 31′. The cylinders 32, 32′ of the units 31, 31′ are articulately connected to the table 27 by substantially vertical pivot members 33, 33′, and the piston rods 30 and 30′ of the units 31, 31′ are connected to the aforementioned sockets 29, 29′, respectively.

The cylinders 32, 32′ are connected with sockets 34, 34′ which, in turn, are articulately connected with the piston rods 35, 35′ of additional double-acting hydraulic cylinder and piston units 36 and 36′, respectively. The cylinders 37, 37′ of the units 36, 36′ are connected to the table 27 by vertical pivot members 38 and 38′. The units 36 and 36′ form part of resistance means opposing pivotal movements of the respective levers 13, 14 in the direction of arrows X.

Figure 8:
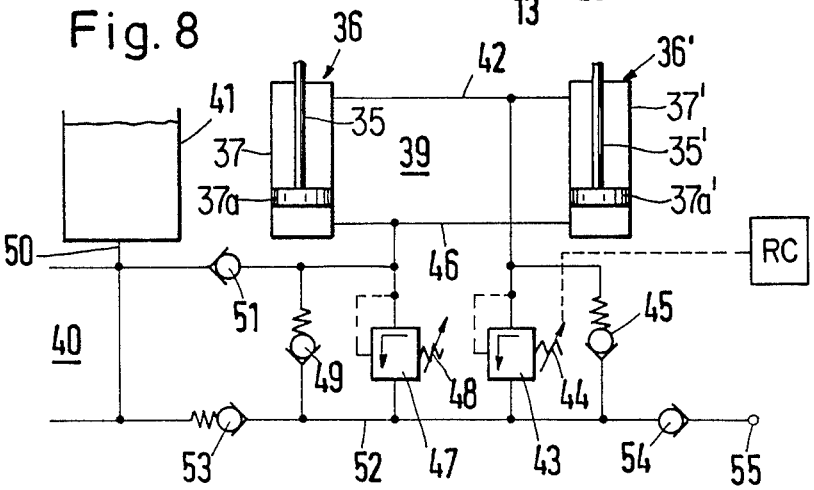
FIG. 8 shows a portion of the hydraulic circuit of the resistance means.

FIG. 8 shows the hydraulic circuit 39 for the cylinder and piston units 36 and 36′. The hydraulic circuit 40 for the cylinder and piston units 31 and 31′ is preferably a mirror image of the circuit 39. The two circuits preferably receive oil or another suitable hydraulic fluid from a common source 41 (this source can constitute or form part of the table 27 and rims 28).

Those chambers of the cylinders 37 and 37′ which receive portions of the respective piston rods 35, 35′ are communicatively connected to each other by a conduit 42 containing an adjustable flow restricting throttle valve 43. Adjusting means 44 is provided to vary the resistance which the valve 43 offers to the flow of fluid from the conduit 42 into a conduit 52 leading to the inlet/outlet 50 of the source 41. A check valve 45 is connected in parallel with the valve 43 to permit the liquid to flow from the conduit 52 into the conduit 42 and into the corresponding chambers of the cylinders 37, 37′ when the piston rods 35, 35′ are caused to move downwardly, as viewed in FIG. 8.

The other chambers of the cylinders 37 and 37′ are connected to each other by a conduit 46 which can discharge liquid into the conduit 52 by way of a flow restricting throttle valve 47 in parallel with a check valve 49. The resistance which the valve 47 offers to the flow of liquid from the conduit 46 into the conduit 52 can be regulated by adjusting means 48. The effective cross-sectional areas of pistons 37*a*, 37*a*′ in the cylinders 37, 37′ are larger in those cylinder chambers which are connected to each other by the conduit 46. The conduit 46 is connected with the inlet/outlet 50 of the source 41 by a check valve 51 which is designed to permit the liquid to flow from the source 41 toward and into the conduit 46. The conduit 52 contains a check valve 53 which permits the liquid to flow toward and into the inlet/outlet 50, and a check valve 54 which can admit liquid from a source 55 to compensate for leakage of liquid from the circuit 39 and/or 40. Alternatively, the part which is denoted by the character 55 can include a sealable funnel which serves to admit liquid from a container at selected intervals or when an inspection reveals that the supply of liquid in the circuits 39, 40 must be replenished.

When the pistons 37*a*, 37*a*′ are moved relative to the respective cylinders 37, 37′ through identical distances and in the same direction as a result of identical pivoting of the levers 13, 14 in the directions of arrows X (namely when the piston rods 35 and 35' are moved upwardly, as seen in FIG. 8), the pistons 37a, 37a' expel liquid from the upper cylinder chambers via conduit 42 whereby the expelled liquid flows through the valve 43 and into the conduit 52. The valve 43 is assumed to constitute a tension-regulated proportional valve which establishes a predetermined cross-sectional area for the flow of liquid from the conduit 42 into the conduit 52; therefore, this valve causes the units 36 and 36' to offer to movement of the levers 13, 14 a resistance which is proportional to the speed of movement of these levers in the direction of arrows X. Liquid which is expelled from the conduit 42 into the conduit 52 flows through the check valve 49 into the conduit 46 and thence into the lower chambers of the cylinders 37 and 37'. Since the rate at which the combined effective area of the two lower cylinder chambers increases is greater than the rate at which the volume of the two upper chambers decreases, the cylinders 37 and 37' draw liquid from the source 41 via inlet/outlet 51, check valve 51 and conduit 46. The valve 47 offers the required resistance to pivoting of the levers 13 and 14 in the opposite direction, namely in a direction to reduce the volume of the two lower cylinder chambers of FIG. 8 because the liquid then flows through the conduit 46, valve 47, conduit 52, check valve 45 and into the conduit 42. Since the rate at which the combined volume of the two upper cylinder chambers increases is less than the rate of reduction of the combined volume of the two lower cylinder chambers, a certain percentage of liquid which leaves the lower cylinder chambers via conduit 46 must flow through the check valve 53 and into the source 41.

If the levers 13, 14 are moved in opposite directions at the same speed and through identical distances, the resistance which they encounter to such movement is very small because the liquid merely flows between the two upper and the two lower cylinder chambers via conduits 42 and 46 and need not pass through any flow restrictor means.

The mode of operation of the hydraulic circuit 40 for the cylinder and piston units 31, 31' is identical or analogous to the just described mode of operation of the circuit 39.

Each movement of the levers 13, 14 (irrespective of the selected direction of movement) entails the development of a certain resistance, and the exerciser can select such resistance within a desired range. To this end, the means 44 and 48 for adjusting the valves 43 and 47 are preferably installed at the exterior of one sidewall of the frame 2 (FIG. 3) so that they can be readily reached by one hand of the person occupying the seat 11. The adjusting means (not specifically shown) for the valves of the hydraulic circuit 40 can be installed at the exterior of the other sidewall of the frame 2 so that the operation of the circuit 39 can be regulated with one hand and the operation of the circuit 40 can be regulated with the other hand of the exerciser.

As already mentioned above, the interior of the front part of the frame 2 can contain the additional or optional exercising unit 56 with two pedals 57 which are accessible to the legs of the person occupying the base 11 when the sections 7 and 8 are caused to assume the positions which are shown in the right-hand portion of FIG. 3. The pedals 57 can be used to rotate a disc against the opposition of an adjustable brake in a well known manner not forming part of the present invention. The operator can select the desired braking action, i.e., the resistance which the pedals offer to rotation about a horizontal axis.

An advantage of the improved exercising apparatus is that it enables the user to exercise any one of a number of different body parts while sitting or lying on the sections 5–8 of the bed 9. Moreover, the user can readily select the resistance or the moment of resistance to each and every movement of the levers 13 and 14, be it in the direction of arrow X, Y or Z. This ensures that a selected muscle or two or more selected muscles will be stressed and strengthened to a desired extent. The adjustability of various resistance means is preferably such that the user of the apparatus can carry out a number of desired exercises or that the apparatus is used as a body building machine. The magnitude of resistance which is offered by the springs 24, cylinder and piston units 31, 31' and/or cylinder and piston units 36, 36' can be selected by hand or automatically in accordance with a selected program. This enables the exerciser to carry out the body building or exercising operation in accordance with a predetermined schedule and for predetermined intervals of time per session.

Since the handles 15, 16 are movable against variable resistance in any one of the directions X, Y and Z, the user of the apparatus 1 can stress the muscles of the arms, legs and/or torso in a manner which is quite different from that when using a conventional exercising apparatus. The user can decide to move the handle 15 and/or 16 in two or three different directions; this even further enhances the utility and versatility of the apparatus by enabling the user to exercise new combinations of muscles, e.g, by causing the handle 15 and/or 16 to simultaneously perform translatory and circulatory movements. The magnitude of the selected resistance will determine whether the apparatus is used as an exercising machine or as a body or muscle building means.

The aforedescribed body supporting facility 5–8 and the handles 15, 16 are designed in such a way that the handles can be moved by the hands or by the legs of the user. Thus, the user can exercise or build the muscles in the upper or in the lower part of her or his body. In fact, by removing or otherwise displacing the section 7 of the bed 9, the user can gain access to the unit 56 so that the pedals 57 can be driven by the legs while the arms move the handles 15 and 16.

Mounting means 17 in the form of spherical joints are preferred at this time because they enable each of the handles 15, 16 to move in any one of a practically unlimited number of different directions including forwardly and rearwardly (arrow X) in parallelism with the sidewalls of the frame 2 as well as inwardly and outwardly (arrow Y) at right angles to the planes of the sidewalls. The cylinder and piston units 31, 31'0 and/or 36, 36' can oppose each and every movement having a component in the direction of arrow X and/or Y.

An advantage of handles 15, 16 having horizontal portions 18, 19 at different distances from the respective mounting means 17 is that the lever arm is different when a hand grasps the portion 18 than when the same hand grasps the portion 19, i.e., the stressing of muscles can be changed by causing the levers 13, 14 to move in response to the application of forces to the portions 18 or 19 of the respective handles 15 and 16. In addition, a hand or a portion of a foot can be inserted into the corresponding space 22 to ensure that the lever 13 or 14 can be moved forwardly by applying a first force to the portion 18 and rearwardly by applying a different second force to the portion 19 or vice versa. The portions 18 of each handle further facilitate a movement of the handles against the opposition of the respective springs 24.

The portions 20, 21 of handles 15, 16 enable hands or feet in the spaces 22 to pivot the handles toward or away from each other (arrow Y).

The purpose of padding 23 is to ensure that the hands or legs can apply large forces without risking the development of blisters or sores.

The illustrated resistance means 24, 31, 31', 36, 36' can be replaced or used in combination with other types of loads which can generate moments of resistance opposing the movements of the levers 13, 14 and pedals 57 in selected directions. For example, the resistance means can comprise or can consist of counterweights, friction generating brakes or prestressed springs. Presently preferred resistance means include hydraulic cylinder and piston units (31, 31', 36, 36') in combination with valves which throttle the flow of hydraulic fluid into and from cylinder chambers of such units. Such valves can be readily adjusted to thus select the magnitude of resistance which is offered by the respective units. The valves can be equipped with adjusting means which respond to changes of electric current to thereby alter the rate of fluid flow therethrough, i.e., the magnitude of the flow restricting or throttling action. The provision of a pair of adjustable throttle valves (43, 47) in each of the circuits 39, 40 renders it possible to select the resistance to forward or inward movements of the handles 15, 16 independently of the resistance to rearward or outward movements. This renders it possible to individually select the stresses upon muscles which cause the handles 15, 16 to perform forward, rearward, inward and outward movements.

It is desirable to actuate one or more adjusting means (such as 44, 48) by remote control RC. The adjusting means can include or can be combined with means for selecting and varying the magnitude of loads in accordance with a predetermined program. Alternatively or in addition to reliance on a predetermined program, it is possible to regulate the resistance in dependency on one or more variable parameters, e.g., the pulse frequency of the exerciser.

If the resistance means uses a hydraulic fluid, the temperature of such fluid will normally vary as a function of the magnitude of stress upon the muscles which are used to move the handles. The apparatus is then equipped with means for monitoring the temperature of hydraulic fluid. The monitored temperature can be displayed on a screen and/or the results of the monitoring operation can be utilized to automatically regulate the load upon the muscles which are used to move the handles 15, 16. The just discussed adjusting means takes advantage of the phenomenon that the temperature of fluid flowing through the orifice of a flow restrictor (such as the valve 43 or 47) varies as a result of friction and that changes of fluid temperature denote the magnitude of the stress upon the muscles of the exerciser.

The components of the hydraulic circuits 39 and 40 can be readily confined in the frame 2. The aforementioned combinations of cylinder and piston units 31, 36 and 31', 36' in each of the circuits 39, 40 ensure the development of resistance to any and all movements of the handles 15, 16 with components in the direction of arrow X and/or Y. The hydraulic circuits 39 and 40 are simple, compact, inexpensive and reliable; they operate with a small number of throttling valves. Moreover, these circuits ensure that both handles encounter the same resistance if they are moved in the same direction, at the same speed and to the same extent. Still further, the user can greatly reduce the stress upon her or his muscles by the simple expedient of moving the handle 15 forwardly or inwardly while the handle 16 is moved rearwardly or outwardly, or vice versa, i.e., by rendering the valves 43 and 47 ineffective.

The stability of the function table 27 (which carries the mounting means 17 and the units 31, 31', 36, 36') can greatly exceed the stability of other parts of the apparatus. This reduces the overall weight, bulk and cost of the apparatus. Additional savings are achieved if the table 27 constitutes or includes the source 41 of hydraulic fluid. The bed 9 can serve to support the user in prone position. The user can move the handles 15, 16 with the hands, lower arms, upper arms, feet, lower legs or upper legs, depending on the nature of the desired exercise or body building operation. Moreover, the bed 9 can serve to support the body of a user during message.

An advantage of the section 6 (which is narrower than the bed 9) is that it provides room for the arms of the person sitting on the section 5 and leaning against the back 6a while the arms grip and move the handles 15 and 16.

Figure 2:
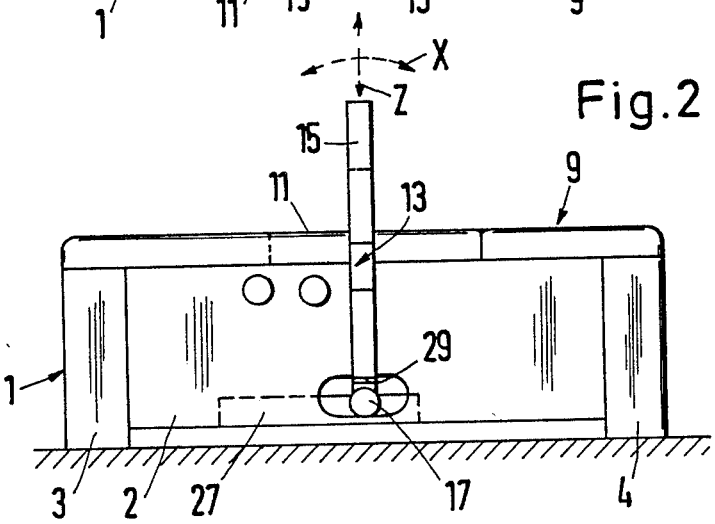
FIG. 2 is a side elevational view of the apparatus which is shown in FIG. 1.
Figure 3:
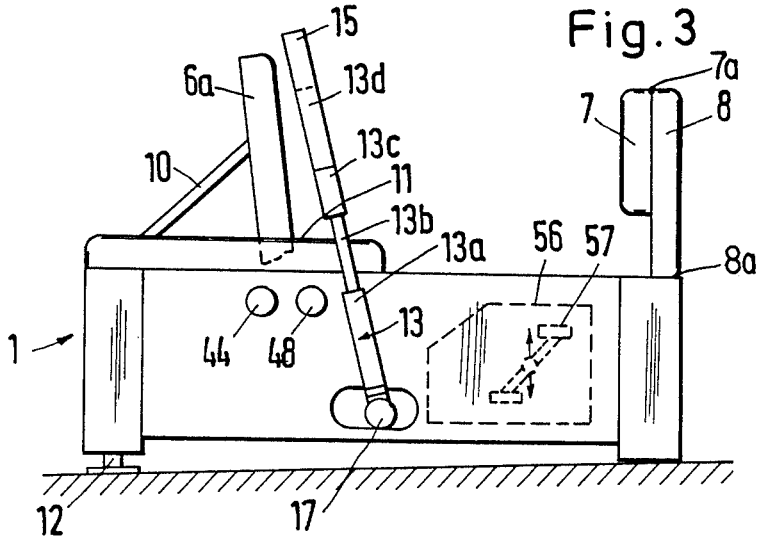
FIG. 3 is a similar side elevational view but showing the levers in extended positions and with the body supporting parts in different positions.

The section 8 and/or 7 can be lifted, removed or otherwise displaced (to leave the position which is shown in FIG. 2) in order to enable the feet of a user to reach the pedals 57 or to simply assume a more comfortable position while the hands move the handles 15 and 16. The closed frame 2 confines and conceals and shields the resistance means, the table 27, the pedals 57 and any other parts which are preferably confined in order to prolong their useful life and/or to enhance the appearance of the apparatus.

The feature that the inclination of the frame 2 and facility 5–8 can be changed is desirable and advantageous because this enables the user to stress the muscles to a different extent by the simple expedient of raising or lowering the head end and/or the other end of the frame, i.e., by extending or retracting selected legs 12 (preferably by remote control). It is further within the purview of the invention to change the level of the handles 15, 16 relative to the level of the pedals 57 and/or relative to bed 9 as well as to change the level of the bed 9 relative to the pedals 57 (or vice versa).

The illustrated exercising apparatus can be modified in a number of ways without departing from the spirit of the invention. For example, the adjusting means 44 and/or 48 (and/or the adjusting means for the valves of the hydraulic circuit 40) can be adjusted by remote control, especially in dependency upon one or more variable parameters such as the pulse frequency of the exerciser or any other parameter which varies as a function of the stress to which the body of the exerciser is subjected in actual use of the apparatus. Still further, the apparatus can be equipped with thermometers which monitor and indicate the temperature of hydraulic fluid downstream of the flow restricting valves; such temperature is indicative of the stress upon the operator of the exercising apparatus.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Exercising apparatus comprising a support having a body supporting facility including a bed having a first section which is convertible into the back of a seat, said bed having a first width and said first section having a second width less than said first width, said bed further including a displaceable second section which is located in front of and is displaceable relative to said first section; two levers each having a handle within reach of a hand and a foot of a person occupying said body supporting facility; means for pivotably mounting said levers on said support with freedom of movement in at least two mutually inclined directions, said mounting means being located at a level beneath said bed; and resistance means for yieldably resisting movements of said levers at least in said at least two directions, said resistance means being provided in said support beneath said bed.

2. The apparatus of claim 1, wherein said mounting means includes a spherical joint for each of said levers.

3. The apparatus of claim 1, wherein said handles are movable toward and away from the respective mounting means longitudinally of the corresponding levers.

4. The apparatus of claim 3 wherein each of said levers comprises a plurality of sections which are movably telescoped into each other.

5. The apparatus of claim 1, wherein each of said handles includes two substantially horizontal portions which are spaced apart from each other in the longitudinal direction of the respective lever.

6. The apparatus of claim 1, wherein each of said handles has two portions which are substantially parallel with the respective lever and are spaced apart from each other transversely of the respective lever.

7. The apparatus of claim 1, wherein said handles are at least partially padded.

8. The apparatus of claim 1, wherein said resistance means comprises at least one prestressed spring for each of said levers.

9. The apparatus of claim 1, wherein said resistance means comprises at least one hydraulic cylinder and piston unit and means for throttling the flow of fluid into and/or from said unit.

10. The apparatus of claim 9, wherein said throttling means includes at least one adjustable valve.

11. The apparatus of claim 1, wherein said resistance means is adjustable to offer a variable resistance to movements of at least one of said levers relative to said support, and further comprising means for adjusting said resistance means.

12. The apparatus of claim 1, wherein said levers are movable forwardly and rearwardly in at least one of said directions, said resistance means including first adjustable loads which oppose forward movements of said levers in said at least one direction and second adjustable loads which oppose rearward movements of said levers in said at least one direction, and further comprising discrete adjusting means for said first and second loads.

13. The apparatus of claim 12, further comprising remote controls for at least one of said adjusting means.

14. The apparatus of claim 12, wherein at least one of said adjusting means includes means for adjusting the respective load in accordance with a predetermined program.

15. The apparatus of claim 12 wherein at least one of said adjusting means includes means for adjusting the respective load in dependency upon the magnitude of stress on the user of the apparatus.

16. The apparatus of claim 1, wherein at least a portion of said resistance means is adjustable and includes a supply of hydraulic fluid the temperature of which varies in dependency on the stress upon the user of the apparatus, and further comprising means for adjusting said portion of said resistance means including means for monitoring the temperature of the fluid.

17. The apparatus of claim 16, wherein said adjusting means further comprises means for displaying the monitored temperature of the fluid.

18. The apparatus of claim 16, wherein said adjusting means further comprises means for regulating the resistance of said portion of said resistance means as a function of changes of the temperature of fluid.

19. The apparatus of claim 1, wherein said mounting means includes a universal joint for each of said levers and said resistance means comprises a first and a second hydraulic cylinder and piston unit for each of said levers, each first unit having a first portion coupled to the respective lever and a second portion pivotally secured to said support for movement about a substantially vertical axis, said first portions being movable relative to the respective second portions, each of said second units including a first portion pivotably secured to said support for movement about a substantially vertical axis and a second portion movable relative to the first portion of the respective second unit and coupled to the second portion of the respective first unit.

20. The apparatus of claim 19, further comprising a source of hydraulic fluid and conduits connecting said source with said units.

21. The apparatus of claim 20, wherein the second portions of said first units and the first portions of said second units are double-acting cylinders each having a first chamber and a second chamber, said conduits comprising first conduits connecting the first chambers of cylinders in each of said first and second units, second conduits connecting the second chambers of cylinders in each of said first and second units, and a third conduit connected to said source, and further comprising a throttle valve connected between each of said first and second conduits and said third conduit, and check valves connected in parallel with said throttle valves to admit fluid from said third conduit to said first and second conduits.

22. The apparatus of claim 19, further comprising a common function table for said mounting means and said units.

23. The apparatus of claim 22, wherein said table constitutes a source of hydraulic fluid for said units.

24. The apparatus of claim 1, further comprising an exercising unit installed in said support beneath said second section.

25. The apparatus of claim 24, wherein said exercising unit includes pedals rotatable about a substantially horizontal axis.

26. The apparatus of claim 1, wherein said support includes a closed frame beneath said bed.

27. The apparatus of claim 1, wherein said frame has sidewalls and said resistance means are adjustable, and further comprising means for adjusting said resistance means, said adjusting means being mounted on at least one of said sidewalls.

28. The apparatus of claim 1, further comprising means for changing the level of said body supporting facility.

29. The apparatus of claim 1, further comprising means for changing the inclination of said body supporting facility.

30. The apparatus of claim 1, further comprising means for changing the level of said handles relative to the level of said body supporting facility.

31. The apparatus of claim 1, further comprising rotary pedals in said support and means for changing the level of said pedals with reference to the level of said body supporting facility.

32. The apparatus of claim 1, further comprising rotary pedals in said support, and means for changing the level of said handles with reference to the level of said pedals.

* * * * *